United States Patent [19]

Joseph

[11] Patent Number: 4,924,273

[45] Date of Patent: May 8, 1990

[54] ROLLER TRANSFER APPARATUS

[75] Inventor: Brian J. Joseph, Rochester, N.Y.

[73] Assignee: Eastman Kodak Company, Rochester, N.Y.

[21] Appl. No.: 339,743

[22] Filed: Apr. 18, 1989

[51] Int. Cl.[5] ..... G03G 21/00; G03G 15/00; B65H 29/54; B65H 5/12

[52] U.S. Cl. ..... 355/312; 271/196; 271/276

[58] Field of Search ..... 355/308, 309, 312; 271/94, 96, 196, 276

[56] References Cited

U.S. PATENT DOCUMENTS

| | | | |
|---|---|---|---|
| 4,202,542 | 5/1980 | Lammers et al. | 271/196 X |
| 4,403,847 | 9/1983 | Chrestensen | 355/312 X |
| 4,550,999 | 11/1985 | Anderson | 355/312 X |
| 4,558,944 | 12/1985 | Bothner | 355/312 |
| 4,740,813 | 4/1988 | Roy | 355/312 X |
| 4,786,046 | 11/1988 | Freeman et al. | 271/276 |

*Primary Examiner*—A. T. Grimley
*Assistant Examiner*—William J. Royer
*Attorney, Agent, or Firm*—Lawrence P. Kessler

[57] ABSTRACT

An improved transfer apparatus for use in an electrostatographic copier including a dielectric member adapted to carry electrostatically developed marking particle images. The transfer apparatus comprises a cylindrical roller mounted for rotation about its longitudinal axis and located such that its peripheral surface is in operative relation with the dielectric member of the copier. A receiver member is selectively tacked, at least at its lead marginal edge, on the peripheral surface of the roller by vacuum attraction, such vacuum being effective through ports in the roller. At least one trough is formed in the roller substantially aligned with the vacuum ports. Such trough minimizes contact of the tacked lead edge of the receiver sheet to the peripheral surface of the roller, thereby facilitating release of the sheet from the roller at a desired time.

9 Claims, 1 Drawing Sheet

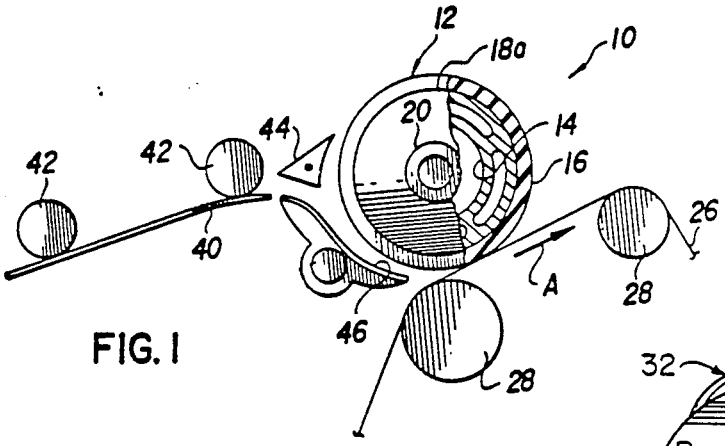
FIG. 1
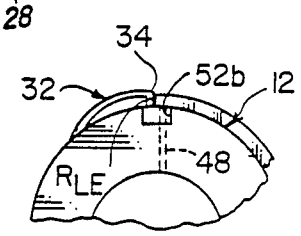
FIG. 3
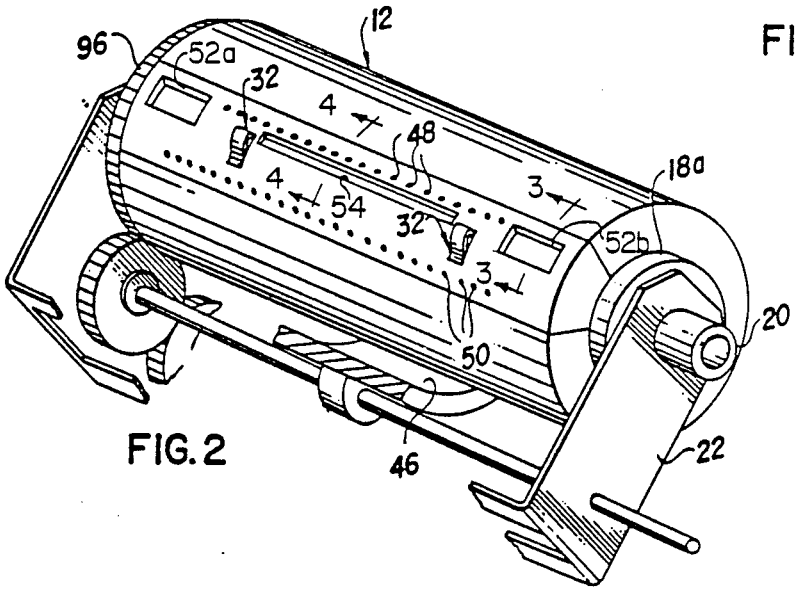
FIG. 2
FIG. 4
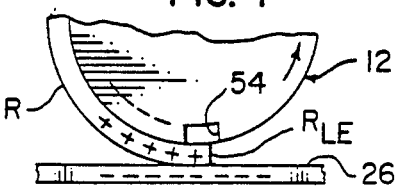
FIG. 5
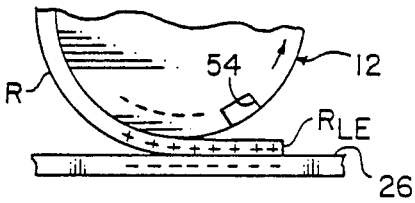

ROLLER TRANSFER APPARATUS

BACKGROUND OF THE INVENTION

This invention relates in general to a transfer apparatus for use for example in an electrostatographic copier, and more specifically to an improved roller transfer apparatus of particular construction to facilitate release of a sheet at a desired time.

In typical electrostatographic reproduction apparatus (copiers or copier/duplicators), marking particles are attracted to a latent image charge pattern formed on a dielectric support to develop such image on the support. The dielectric support is then brought into contact with a receiver member and an electric field applied to transfer the marking particle developed image to the receiver member from the dielectric support. After transfer, the receiver member bearing the transferred image is transported away from the dielectric support and the image is fixed to the receiver member by heat and/or pressure to form a permanent reproduction thereon.

Application of the electric field to effect marking particle transfer is generally accomplished by ion emission from a corona charger onto the receiver member, or by supporting the receiver member on an electrically biased roller holding the receiver member against the dielectric support. While roller transfer apparatus are inherently more complex than corona transfer apparatus, roller transfer apparatus offer certain advantages. For example, roller transfer apparatus typically require a lower energy budget, and also maintain a more positive (physical) control over the receiver member. This positive control is particularly desirable when a receiver member must be recirculated to have multiple images transferred thereto, such as in making multicolor reproductions.

Positive control over the receiver member on the transfer roller has heretofore been provided by mechanical grippers or vacuum mechanisms. Mechanical grippers, such as shown in U.S. Pat. No. 3,612,667 (issued Oct. 12, 1971, in the name of Langdon et al) are of complex construction. For example, the grippers must be recessible within the periphery of the transfer roller to prevent their contacting the dielectric member and causing damage thereto. Vacuum tacking mechanisms, while of a much more simple construction, may not provide sufficient control over the location of the lead edge of the receiver member for accurate registration of the marking particle images on the dielectric member relative to the receiver member. Any misregistration may result in the reproduction on such receiver member being of unacceptable quality. In order to provide more accurate positioning of a receiver member on the peripheral surface of a transfer roller, an apparatus as shown in U.S. Pat. No. 4,724,458 (issued Feb. 9, 1988, in the names of Roy, et al) has been described. The transfer roller apparatus according to this patent includes a locating and vacuum tacking mechanism of simple construction which is capable of accurately locating a receiver member on the periphery of the roller without damaging the dielectric member of the copier.

SUMMARY OF THE INVENTION

This invention is directed to an improved transfer apparatus for use in an electrostatographic copier including a dielectric member adapted to carry electrostatically developed marking particle images. The transfer apparatus comprises a cylindrical roller mounted for rotation about its longitudinal axis and located such that its peripheral surface is in operative relation with the dielectric member of the copier. A receiver member is selectively tacked, at least at its lead marginal edge, on the peripheral surface of the roller by vacuum attraction, such vacuum being effective through ports in the roller. At least one trough is formed in the roller substantially aligned with the vacuum ports. Such trough minimizes contact of the tacked lead edge of the receiver sheet to the peripheral surface of the roller, thereby facilitating release of the sheet from the roller at a desired time.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 1 is an end elevational view of the transfer apparatus incorporating the improvement according to this invention, with a portion broken away to facilitate viewing;

FIG. 2 is a view, in perspective, of the transfer apparatus of FIG. 1;

FIG. 3 is an end elevational view, in cross-section, of a portion of the roller of the transfer apparatus, incorporating the improvement according to this invention, taken along lines 3—3 of FIG. 2; and FIGS. 4 and 5 are end elevational views, partly in cross-section, of a portion of the roller of the transfer apparatus incorporating the improvement according to this invention, respectively showing tacking and release of the lead edge of a receiver member.

DESCRIPTION OF THE PREFERRED EMBODIMENT

Referring now to the accompanying drawings, FIG. 1 shows a transfer apparatus, designated generally by the numeral 10, substantially as shown and described in the aforementioned U.S. Pat. No. 4,724,458. The transfer apparatus 10 includes a substantially cylindrical roller 12 comprising a conductive core 14 having a surface layer 16 formed thereon. The surface layer 16, which may be of an insulating, semi-insulating, or conductive material for example, is tailored to yield optimum production of an electric transfer field for effecting transfer of a marking particle image from a dielectric image-carrying member to receiver member supported on such surface layer.

The core 14 of the roller 12 is coupled to end gudgeons 18 which have integrally formed stub shafts 20 (only one shown in FIG. 1) extending therefrom coaxially with the longitudinal axis of the roller 12. As shown in FIG. 2, the shafts 20 are mounted in a frame 22 for free rotation about their longitudinal axes. The peripheral surface layer 16 of the roller is in operative transfer association with a dielectric member 26.

The dielectric member 26, supported for movement in the direction of arrow A about rollers 28, is adapted to carry electrostatically developed marking particle images in sequential image areas of the member. Formation of such images in the sequential image areas of the dielectric member may be accomplished by any well known technique, such as electrostatographically for example. With an electrical transfer field applied between the roller 12 and the dielectric member 26, the marking particle images are transferred from the dielectric member to a receiver member supported on the peripheral surface of the roller 12.

In order to carry out accurate transfer of marking particle images to receiver members, a receiver member must be accurately located on the peripheral surface of the transfer roller 12, and the angular position of the roller (and the receiver member located thereon) must be accurately related to the location of the marking particle image on the dielectric member. Such accurate location is especially necessary when a plurality of marking particle images are to be transferred to a receiver member in superimposed register, as in forming a multi-color reproduction. Accurate location of a receiver member on the peripheral surface 16 of the roller 12 is accomplished by a pair of flexible locating members 32 secured to the surface 16 of the transfer roller 12 at spaced locations along an element thereof (see FIG. 2).

The flexible locating members 32 each have a receiver member locating feature 34 aligned with each other to align the lead edge $R_{LE}$ of a receiver member R on the surface of the roller 12. Of course, any desired number of flexible members may be utilized with this invention. The construction of the flexible members 32 is such that the locating feature normally extends above the peripheral surface 16 of the roller 12. A cavity (not shown) in the roller 12 is positioned below the feature to receive the feature when the flexible member 32 (and thus the feature) is urged radially inwardly with respect to the roller as the roller rotates into opposed relation with the dielectric member 26. When the flexible member is received within the cavity, its outermost surface is coincident with, or below, the peripheral surface 16 of the roller 12.

A receiver member is transported toward the transfer apparatus 10 along a guide plate 40 by any well known transport mechanism, such as rotating scuff rollers 42. A deflector 44 and a guide 46 cooperate to direct the lead edge of a transported receiver member into engagement with the transfer roller 12 upstream of the transfer zone formed by the nip between the roller and the dielectric member. The roller 12 is angularly positioned to locate the flexible members 32 for engagement of the transported receiver member with the features 34 as the receiver member engages the roller. The linear velocity for the transported receiver member is selected to be somewhat greater than linear velocity of the roller surface 16 so that the receiver member is over driven into the features 34. This insures that the lead edge of the receiver member is accurately engaged with the features.

The receiver member, located by the features of the flexible members 32, is retained in its accurate location on the peripheral surface 16 of the transfer roller 12 by vacuum tacking of the lead and trail edges of such receiver member to the peripheral surface. To effect such vacuum tacking, the transfer roller 12 includes a first series of ports 48 and a second series of ports 50. The first series of ports 48 is defined by, and extends through, a segment of the roller 12 immediately up stream of the features 34; and, the second series of ports 50 is defined by, and extends through, a segment of the roller immediately downstream of the flexible members 32. The series of ports 48 and 50 are selectively connected to a vacuum source V in the manner fully described in the aforementioned U.S. Pat. No. 4,724,458.

In order to detack a receiver member from the transfer roller 12 at a desired time (after transfer of developed images to the receiver member), the vacuum at the ports 48 is removed. Forces effective to separate the receiver member from the roller are the beam strength of the receiver member and, to an extent, the electrostatic attraction of the receiver member to the dielectric member 26. Of course, beam strength is a function of the material properties of the receiver member and the diameter of the transfer roller 12, while electrostatic attraction is a function of the charge on the dielectric member to induce a charge in the receiver member so as to attract the receiver member thereto. Charge on the receiver member is also a function of the conductivity of the receiver member, which for a paper receiver member is dependent upon humidity.

Accordingly, when the vacuum at the lead edge ports 48 is removed in order to effect detack, dependent upon the separation forces the receiver member R follows either the dielectric member 26 or the transfer nip. Under certain circumstances, electrostatic attraction of receiver member to the dielectric member is negligible when compared to electrostatic attraction of the receiver member to the transfer roller, especially under low humidity conditions. If the electrostatic attraction to the receiver member by the transfer roller is high, the receiver member will follow the roller. Since this is not the desired path for a detacked receiver member, it is necessary to provide some mechanism to overcome any tendency of the receiver member to follow the transfer roller 12.

According to this invention, the transfer roller 12 is provided with troughs **52*a*, 52*b* and 54. Troughs 52*a*, 52*b* are located along the element which includes the ports 48 respectively outboard of these ports, and trough 54 is located immediately upstream of the ports 48 between the flexible locating members 32. The troughs 52*a*, 52*b* and 54 respectively have a dimension, in the circumferential direction, so as to span the lead edge $R_{LE}$ of the receiver member R thereby minimizing the contact of the lead edge with the roller. The troughs do not extend, in the longitudinal direction, across the area of the roller 12 adjacent to the features 34 of the flexible locating members 32**. This arrangement is necessary to provide lands to support the receiver member lead edge in proper registration contact with the locating members.

As best shown in FIGS. 3, 4 and 5, the configuration of the troughs **52*a*, 52*b* and 54 cause the lead edge $R_{LE}$ of the receiver member to be primarily in contact with the dielectric member 26. Thus during the release phase for the receiver member R, the electrostatic forces between the dielectric member 26 and the receiver member are controlling and result in the receiver member being attracted to the dielectric member to follow the dielectric member in the intended manner. Moreover, once the release phase is begun, the electrostatic charge on the receiver member will be polarized on the receiver member to aid in the release since the attraction of the receiver member to the dielectric member is increased to, in effect, peel the receiver member off of the transfer roller 12**.

The invention has been described in detail with particular reference to preferred embodiments thereof, but it will be understood that variations and modifications can be effected within the spirit and scope of the invention.

We claim:

1. A transfer apparatus located such that its peripheral surface is in operative relation with the dielectric member of an electrostatographic copier, said transfer apparatus comprising:

means for selectively tacking at least the lead marginal edge of a receiver member on the peripheral surface of said apparatus along an element thereof; and means defined in the peripheral surface of said apparatus substantially aligned with said tacking means for minimizing contact of the tacked lead edge of the receiver sheet to the peripheral surface of said apparatus, thereby facilitating release of the sheet from said apparatus at a desired time.

2. The invention of claim 1 wherein said tacking means includes a plurality of ports defined in the peripheral surface of said transfer apparatus and aligned along an element of said surface, and a vacuum source selectively coupled to said ports.

3. The invention of claim 2 wherein said minimizing means includes at least one trough defined in the peripheral surface of said transfer apparatus adjacent to said ports.

4. The invention of claim 2 wherein said minimizing means includes a pair of troughs defined in the peripheral surface of said transfer apparatus, said troughs being substantially aligned with said ports and extending away from said ports adjacent to the outboard ends of said apparatus respectively.

5. The invention of claim 4 wherein said minimizing means further includes an additional trough located immediately upstream of said ports and axially spaced between said pair of troughs.

6. An improved transfer apparatus including a substantially cylindrical roller mounted for rotation about its longitudinal axis and located such that its peripheral surface is in operative relation with the dielectric member of an electrostatographic copier, a plurality of ports defined in the peripheral surface of said transfer roller and aligned along an element of said surface, and a vacuum source selectively coupled to said ports for selectively tacking at least the lead marginal edge a receiver member on the peripheral surface of said roller along an element of said roller, the improvement comprising:

means defined in the peripheral surface of said roller for minimizing contact of the tacked lead edge of the receiver sheet to the peripheral surface of said roller, thereby facilitating release of the sheet from said roller at a desired time.

7. The invention of claim 6 wherein said minimizing means includes at least one trough defined in the peripheral surface of said roller, said trough being located adjacent to said ports.

8. The invention of claim 6 wherein said minimizing means includes a pair of troughs defined in the peripheral surface of said roller, said troughs being substantially aligned with said ports and extending away from said ports adjacent to the outboard ends of said roller respectively.

9. The invention of claim 8 wherein said minimizing means further includes an additional trough located immediately upstream of said ports and axially spaced between said pair of troughs.

* * * * *